US005494411A

United States Patent [19]

Chuang

[11] Patent Number: 5,494,411

[45] Date of Patent: Feb. 27, 1996

[54] PORTABLE HAND AIR PUMP HAVING COLLAPSIBLE HANDLE AND FOOTSTAND

[76] Inventor: Louis Chuang, 7th Floor-8 No. 20, Ta Lon Rd., Taichung, Taiwan

[21] Appl. No.: 441,086

[22] Filed: May 15, 1995

[51] Int. Cl.[6] ..... F04B 33/00

[52] U.S. Cl. ..... 417/234; 417/437; 92/58.1

[58] Field of Search ..... 417/234, 437, 417/555.1; 92/58.1

[56] References Cited

U.S. PATENT DOCUMENTS

| | | | |
|---|---|---|---|
| 785,154 | 3/1905 | Cordeau | 92/58.1 |
| 1,310,876 | 7/1919 | Savage | 92/58.1 |
| 1,356,160 | 10/1920 | Lawley | 92/58.1 |
| 2,462,980 | 3/1949 | Litt | 92/58.1 |
| 5,347,913 | 9/1994 | Stepner | 92/58.1 |
| 5,433,136 | 7/1995 | Lung-Po | 417/234 |

*Primary Examiner*—Richard A. Bertsch
*Assistant Examiner*—Roland G. McAndrews, Jr.
*Attorney, Agent, or Firm*—Charles E. Baxley

[57] ABSTRACT

A portable hand air pump includes a pump body having a foot support pivotally coupled to the bottom portion and having a hook secured to the upper portion. A hose has one end coupled to the pump body and has an attachment member secured to the other end for for engaging with a tire valve and for engaging with the hook so as to be secured to the pump body. An operating rod is slidably engaged in the pump body and has a hand grip pivotally coupled to the upper end. The foot support, the hose and the hand grip may be folded to a rather compact structure.

1 Claim, 3 Drawing Sheets

PORTABLE HAND AIR PUMP HAVING COLLAPSIBLE HANDLE AND FOOTSTAND

BACKGROUND OF THE INVENTION

1. Field of the Invention

The present invention relates to an air pump, and more particularly to a portable hand air pump.

2. Description of the Prior Art

Typical hand air pumps comprise a pump body having an operating rod slidably engaged therein for operating a piston so as to generate pressurized air. However, typical portable hand air pumps comprise a mouth that is required to be directly engaged onto the tire valve. This is inconvenient.

The present invention has arisen to mitigate and/or obviate the afore-described disadvantages of the conventional hand air pumps.

SUMMARY OF THE INVENTION

The primary objective of the present invention is to provide a hand air pump which may be easily carried and which may be easily operated.

In accordance with one aspect of the invention, there is provided a portable hand air pump comprising a pump body including a bottom portion having a base provided therein and including an upper portion having a sleeve provided thereon, the base including a projection provided thereon, and the sleeve including a hook means secured thereto, a foot pedal including a first end pivotally coupled to the base and including a second end having an engaging hole formed therein for engaging with the projection of the base so as to secure the foot pedal to the base, a hose including a first end coupled to the bottom portion of the pump body and including a second end having an attachment member provided thereon for engaging with a tire valve means and for engaging with the hook means of the sleeve so as to secure the hose to the pump body, and an operating rod slidably engaged in the pump body and including an upper end having a hand grip pivotally coupled thereon at a pivot shaft for actuating the operating rod, the hand grip including a chamber formed therein for receiving the upper end of the operating rod and including an opening for engaging with the operating rod so as to allow the hand grip to rotate about the pivot shaft.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
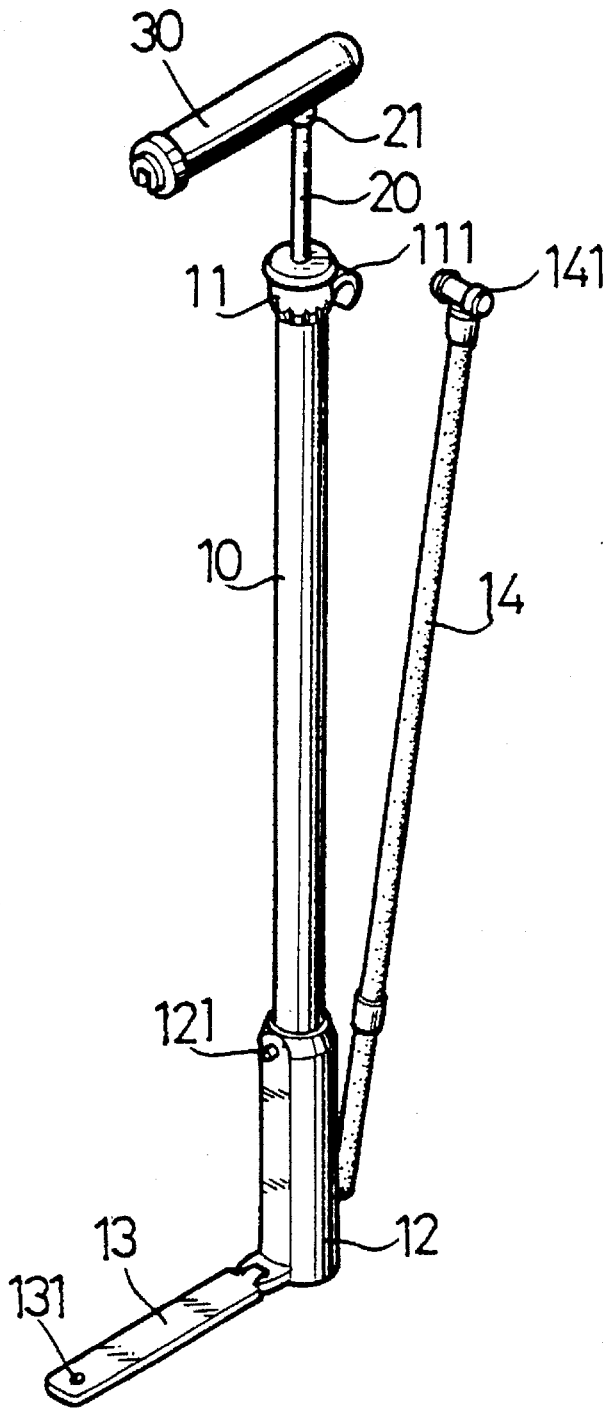
FIG. 1 is a perspective view of a hand air pump in accordance with the present invention.
Figure 2:
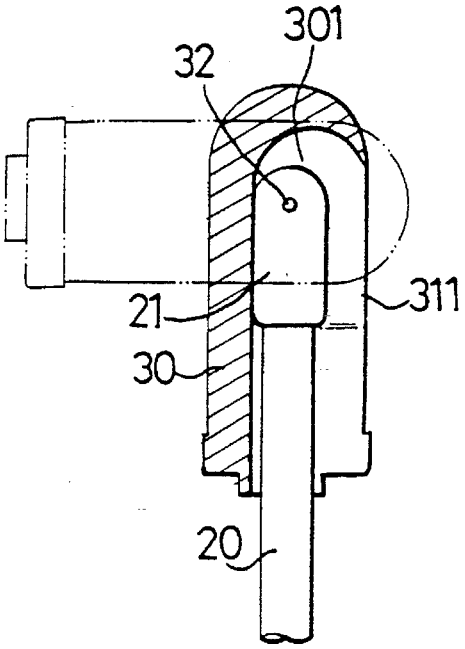
FIG. 2 is a partial cross sectional view of the hand air pump.
Figure 3:
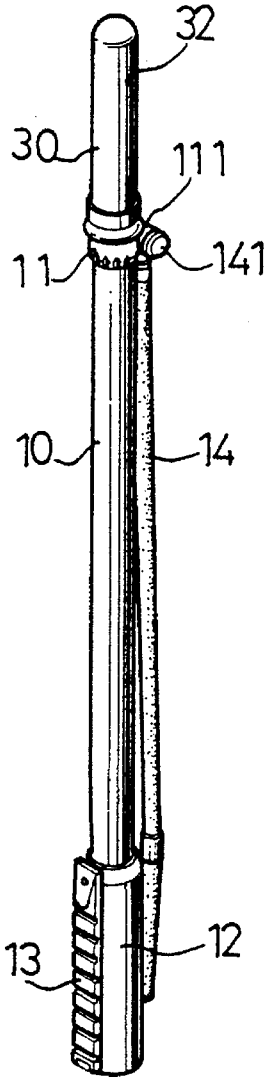
FIG. 3 is a perspective view showing the folded configuration of the hand air pump.

Referring to the drawings, and initially to FIGS. 1 to 3, a portable hand air pump in accordance with the present invention comprises a pump body 10 including a base 12 having a projection 121 provided thereon and including a sleeve 11 provided on top thereof. The sleeve 11 includes a hook means 111 secured thereto. A foot pedal 13 includes one end pivotally coupled to the base 12 and includes an engaging hole 131 formed in the other end for engaging with the projection 121 of the base 12 so as to secure the foot pedal 13 to the base 12. A hose 14 includes a bottom end coupled to the bottom portion of the pump body 10 and includes an attachment member 141 provided on the upper portion for engaging with the tire valve and for engaging with the hook means 111 of the sleeve 11 so as to secure the hose 14 to the pump body 10. The foot pedal 13 and the hose 14 may both be secured to the pump body 10 such that the hand air pump includes a rather compact configuration which is excellent for transportation and for storing purposes.

As best shown in FIG. 2, an operating rod 20 is slidably engaged in the pump body 10 and includes a hand grip 30 provided on top thereof for actuating the operating rod 20. The operating rod 20 includes an upper end 21 having a pivot shaft 32 provided therein. The hand grip 30 includes a chamber 301 formed therein for engaging onto the upper end 21 of the operating rod 20 and includes an opening 311 for engaging with the operating rod 20. The hand grip 30 is pivotally coupled to the pivot shaft 32 and is rotatable about the pivot shaft 32 to a position in perpendicular to the operating rod 20, as shown in FIG. 1. The hand grip 30 may also be rotated about the pivot shaft 32 to engage the operating rod 20 in the chamber 301 such that the hand grip 30 may also be folded to a rather compact configuration.

Figure 4:
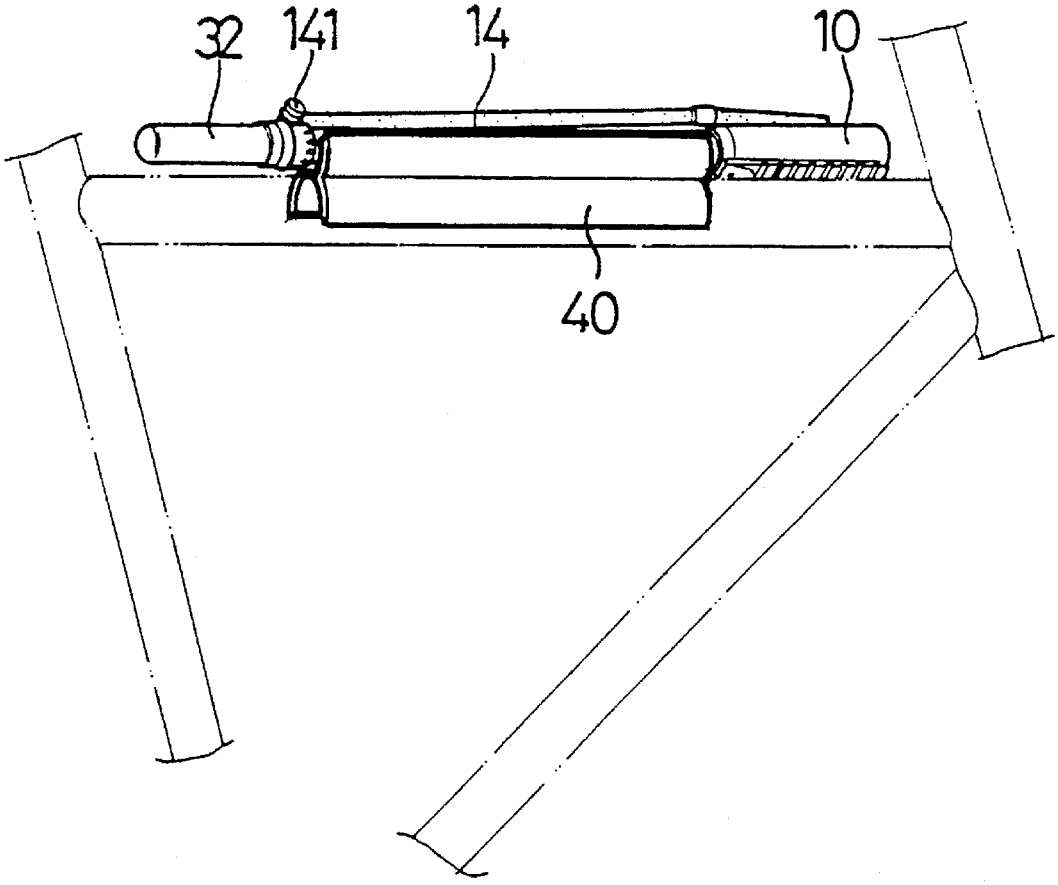
FIG. 4 is a schematic view illustrating the attachment of the hand air pump to the bicycle.

Referring next to FIG. 4, the portable hand air pump may also be easily secured on the top tube of a bicycle by a coupling means 40.

Accordingly, the hand air pump in accordance with the present invention includes an attachment member 141 that may be easily engaged with a tire valve for pumping tires. Both the foot support and the hose may be secured to the pump body, and the hand grip may also be folded relative to the operating rod to a compact configuration for transportation and for storing purposes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A portable hand air pump comprising:

a pump body including a bottom portion having a base provided therein and including an upper portion having a sleeve provided thereon, said base including a projection provided thereon, and said sleeve including a hook means secured thereto, a foot pedal including a first end pivotally coupled to said base and including a second end having an engaging hole formed therein for engaging with said projection of said base so as to secure said foot pedal to said base, a hose including a first end coupled to said bottom portion of said pump body and including a second end having an attachment member provided thereon for engaging with a tire valve means and for engaging with said hook means of said sleeve so as to secure said hose to said pump body, and an operating rod slidably engaged in said pump body and including an upper end having a hand grip pivotally coupled thereon at a pivot shaft for actuating said operating rod, said hand grip including a chamber formed therein for receiving said upper end of said operating rod and including an opening for engaging with said operating rod so as to allow said hand grip to rotate about said pivot shaft.

* * * * *